US010787811B2

(12) United States Patent
Correa Giraldo et al.

(10) Patent No.: US 10,787,811 B2
(45) Date of Patent: Sep. 29, 2020

(54) PREFABRICATED STRUCTURAL BAMBOO SYSTEM FOR SLABS AND ROOFS

(71) Applicant: KALTIA CONSULTORIA PROYECTOS, S.A. DE C.V., Distrito Federal (MX)

(72) Inventors: Veronica Maria Correa Giraldo, Cuauhtemoc (MX); Esteban Flores Mendez, Tlalpan (MX); Joao Gabriel Boto de Matos Caeiro, Oaxaca (MX); Mathieu Queiros, Cuauhtemoc (MX)

( * ) Notice: Subject to any disclaimer, the term of this patent is extended or adjusted under 35 U.S.C. 154(b) by 79 days.

(21) Appl. No.: 15/119,154

(22) PCT Filed: Jan. 22, 2016

(86) PCT No.: PCT/MX2016/000003
§ 371 (c)(1),
(2) Date: May 14, 2018

(87) PCT Pub. No.: WO2016/122302
PCT Pub. Date: Aug. 4, 2016

(65) Prior Publication Data

US 2019/0119913 A1 Apr. 25, 2019

(30) Foreign Application Priority Data

Jan. 28, 2015 (MX) ..... A/2015/001287

(51) Int. Cl.

| | |
|---|---|
| ***E04B 5/12*** | (2006.01) |
| ***E04B 5/10*** | (2006.01) |
| ***E04C 3/10*** | (2006.01) |
| ***E04C 3/292*** | (2006.01) |
| ***E04B 7/00*** | (2006.01) |

(Continued)

(52) U.S. Cl.
CPC ..... *E04B 5/12* (2013.01); *E04B 5/10* (2013.01); *E04B 7/00* (2013.01); *E04C 3/10* (2013.01); *E04C 3/18* (2013.01); *E04C 3/292* (2013.01); *E04B 2005/235* (2013.01); *E04B 2103/04* (2013.01)

(58) Field of Classification Search
CPC ..... E04B 5/12; E04B 5/02
See application file for complete search history.

(56) References Cited

U.S. PATENT DOCUMENTS 3,712,010 A 1/1973 Porter et al.
3,967,426 A * 7/1976 Ault ..... E04B 5/40 52/252

(Continued)

FOREIGN PATENT DOCUMENTS

AU 495802 B2 10/1976
CN 101408039 A 4/2009

(Continued)

*Primary Examiner* — Paola Agudelo
(74) *Attorney, Agent, or Firm* — Caesar Rivise, PC

(57) ABSTRACT

This invention refers to a structural system for floor and roof construction, based on a parallel arrangement of a set of composite pre-tensioned girders to provide support to a deck formed by layers of any given material. The composite girders are components formed by lengths of bamboo culms, steel components and fillings of mortar or other materials, arranged in such way that a maximum mechanical efficiency is obtained.

18 Claims, 3 Drawing Sheets

(51) Int. Cl.
*E04C 3/18* (2006.01)
*E04B 5/23* (2006.01)

(56) References Cited

U.S. PATENT DOCUMENTS 4,159,604 A * 7/1979 Burrell ..... E04C 3/292 52/376
4,446,668 A * 5/1984 Christ-Janer ..... E04C 3/29 52/836
4,584,809 A * 4/1986 Stanford ..... E04C 3/292 52/376
4,615,163 A * 10/1986 Curtis ..... E04C 5/07 52/309.13
5,441,787 A * 8/1995 Fujii ..... B27L 11/08 144/358
5,505,238 A * 4/1996 Fujii ..... B27L 7/00 144/346
5,543,197 A * 8/1996 Plaehn ..... B27N 3/04 144/333
5,634,308 A * 6/1997 Doolan ..... E01D 2/00 14/73
6,173,550 B1 * 1/2001 Tingley ..... B29C 70/025 52/837
6,389,766 B1 * 5/2002 Jackson ..... E04C 3/18 52/223.11
6,576,331 B1 * 6/2003 Ryan ..... B27N 5/00 428/297.4
8,561,373 B1 * 10/2013 McDonald ..... E04C 3/14 52/841
2005/0048273 A1 * 3/2005 Ryan ..... B29C 44/322 428/297.4
2005/0161852 A1 * 7/2005 Decker ..... B27N 3/04 264/109
2008/0023868 A1 * 1/2008 Slaven ..... B27N 1/00 264/109
2010/0083605 A1 * 4/2010 Wallner ..... B23B 5/163 52/655.1
2011/0036042 A1 * 2/2011 Slaven, Jr. ..... E04C 3/122 52/650.1
2016/0325530 A1 * 11/2016 Slaven, Jr. ..... B32B 21/08

FOREIGN PATENT DOCUMENTS

CN 101967852 A * 2/2011
CN 101967852 A 2/2011
CN 103161318 A 6/2013
CN 104032832 A 9/2014

* cited by examiner

PREFABRICATED STRUCTURAL BAMBOO SYSTEM FOR SLABS AND ROOFS

FIELD OF THE INVENTION

The present invention belongs to the construction industry field, and directly relates to a bamboo building system that works as roofing or flooring for buildings.

BACKGROUND OF THE INVENTION

The source of inspiration for this invention is the native architecture in countries that preserve bamboo construction practices. China and India in Asia and Colombia, Peru and Equator in Latin-America are countries with an old building tradition based on this material, featuring multiple examples of building solutions for slabs and roofs, which can be appreciated in their traditional constructions. In present day terms and considering the quality trends, systematization of processes and semi-industrialized or industrialized production of building components or systems, low energy consumption and sustainable development, Colombia stands out by being the first country that approved the first seismic design standard for structures built with one bamboo species (*Guadua angustifolia*): NSR-10 Sections G and E, with attached manuals and publications regarding the construction of seismic-resistant housing using cemented bahareque (a construction material similar to adobe, consisting of clay and mud reinforced with sticks or canes), repair of houses with this building system, and practices for growing, preserving, treating and quality grading the plant for its transformation into a suitable building material.

Said documents contain, among others, design parameters, methodology and a set of recommendations for building structural systems using this material. The present invention takes into consideration the requirements set forth by the Colombian Standard for the design of structural components of *Guadua angustifolia*, and the applicable building Mexican Official Standards and the Building Regulations of the Federal District (Mexico City) for Design and Construction in force. Moreover, it takes into consideration the design specifications of the ASD/LRFD Manual National Design Specification (NDS) for Wood Construction (2012), and Eurocode 5: Wood Structures Design (EN 1995-1-1:2004+AI:2008).

In the state of the art there are several patents and utility models regarding bamboo slab systems, especially in China. However, none of the revised documents has proposed a system similar to that disclosed in this document. The closest prior patents and utility models related to the present invention are: patent application CN101775865A, which uses two bamboo culms, one on a top bed and the other on a bottom bed, screwed together with steel bars; the steel works absorbing the shear stress and integrating both culms to work together in flexural collaboration. Patent application CN101914975A discloses a gabled roof system with parallel bamboo girders that provide support to the deck; the girders transmit the load to the wood truss and this in turn transmits the load to the columns. Patent application CN102518213A proposes an inclined bamboo girder connected to the column with bolts, with mortar filling in the internode of the connecting girder.

Utility model application CN201254784Y discloses a girder consisting of multiple culms that produce a rectangular girder with its ends joined by a plate on each side. Utility model application CN201857698U discloses a laminated bamboo girder. Utility model application CN202194252U proposes a bolted connection between a beam and a column. Utility model application CN202324326U discloses a frame system with columns formed by laminated plates braced with bolts that are connected to a beam formed by laminated plates joined with mounting steel supports. Utility model application CN202509682U discloses a bamboo culm that works as a girder, which is attached to a flooring deck, the possibility of resolving the arrangement of the deck is performed via bamboo cut outs providing a flat surface on top of the girder. Utility model application CN202645019U discloses a hollow rectangular cross-section girder manufactured from bamboo laminates, having a pre-tensioned cable passing through, and anchored by steel plates to the ends of the girder, thus compressing the bamboo surrounding the cable. US patent application US2011151172A1 discloses a pre-tensioned structural material consisting of several bamboo culms joined together forming a hexagonal cross-section unit that enables bonding several units in a rectangular girder leaving no interstices between them. In none of the patent documents previously described the pre-compressed bamboo culms form a girder consisting of pre-tensioned steel, generating a cambered component. The document that closest resembles the present invention is utility model application CN202645019U disclosing a pre-tensioned girder, however, said girder consists of bamboo sheets and a steel cable placed within, which makes the system less mechanically efficient than the system proposed in the present invention because the position of the neutral axis inside the bamboo girder of the invention determines that a part of the bamboo is not to be subject to work forces.

OBJECTS OF THE INVENTION

The main object of the invention is a structural system for the construction of flooring and roofing, supported by an arrangement of parallel pre-tensioned composite girders. Each girder consists of two regions: a) the top region and b) the bottom region, said regions managing compression and stress, respectively.

Another object of the invention the top region of the girder consisting of a bamboo culm section defining the length, and a bottom region consisting of a steel profile connected to the bamboo culm at its ends, and separated from the bamboo culm midway through the span, by one or several bolts sheathed by a tube.

Another object of the invention is the deck consisting of one or several layers of materials that perform the role of a structural diaphragm and a surface finish for the top and bottom regions of the system. The diaphragm transfers the loads acting over the roof or floor to the pre-tensioned composite girders by bracing or by providing deformation-resistance, making the supporting columns or walls work together; and providing flexion and shear stress over-resistance to the composite girders via a connection system, also providing a constant resistance to lateral warping.

Another objective of the present invention is generating a comprehensive system that integrally behaves to guarantee warping uniformity and appropriate transfer of the occupant load and accidental loading to the supporting components of the structure, such as beams, walls and columns, among others.

Another objective of the present invention is providing aesthetic, acoustic, and thermal features to the top and bottom finishing layers.

Another objective of the present invention is the use of the pre-tensioned composite girders consisting of components whose geometrical configuration, dimensions and resistance provide an improved mechanical efficiency and material optimization in girders specifically built for sizing the components according to the needs of use, comfort and finance.

Another objective of the present invention is that the bamboo culm alone or the bamboo culm plus the diaphragm withstand compression, and the longitudinal steel components withstand the tension under the culm. It is important to point out that the components of the girder are arranged so that both the culm and certain steel components are pre-tensioned, creating the initial camber condition of the girder, which disappears or is reduced under the action of loads.

Another objective of the present invention is a bamboo culm having shear stress transmission zones having a special preparation to prevent the occurrence of local failures, such as tearing along the planes parallel to the fibers, warping or crushing, in order to guarantee a ductile failure condition.

Other objects and aspects of the present invention will be obvious for individuals of ordinary skills in the art upon reading the following disclosure.

DETAILED DESCRIPTION OF THE INVENTION

Figure 1:
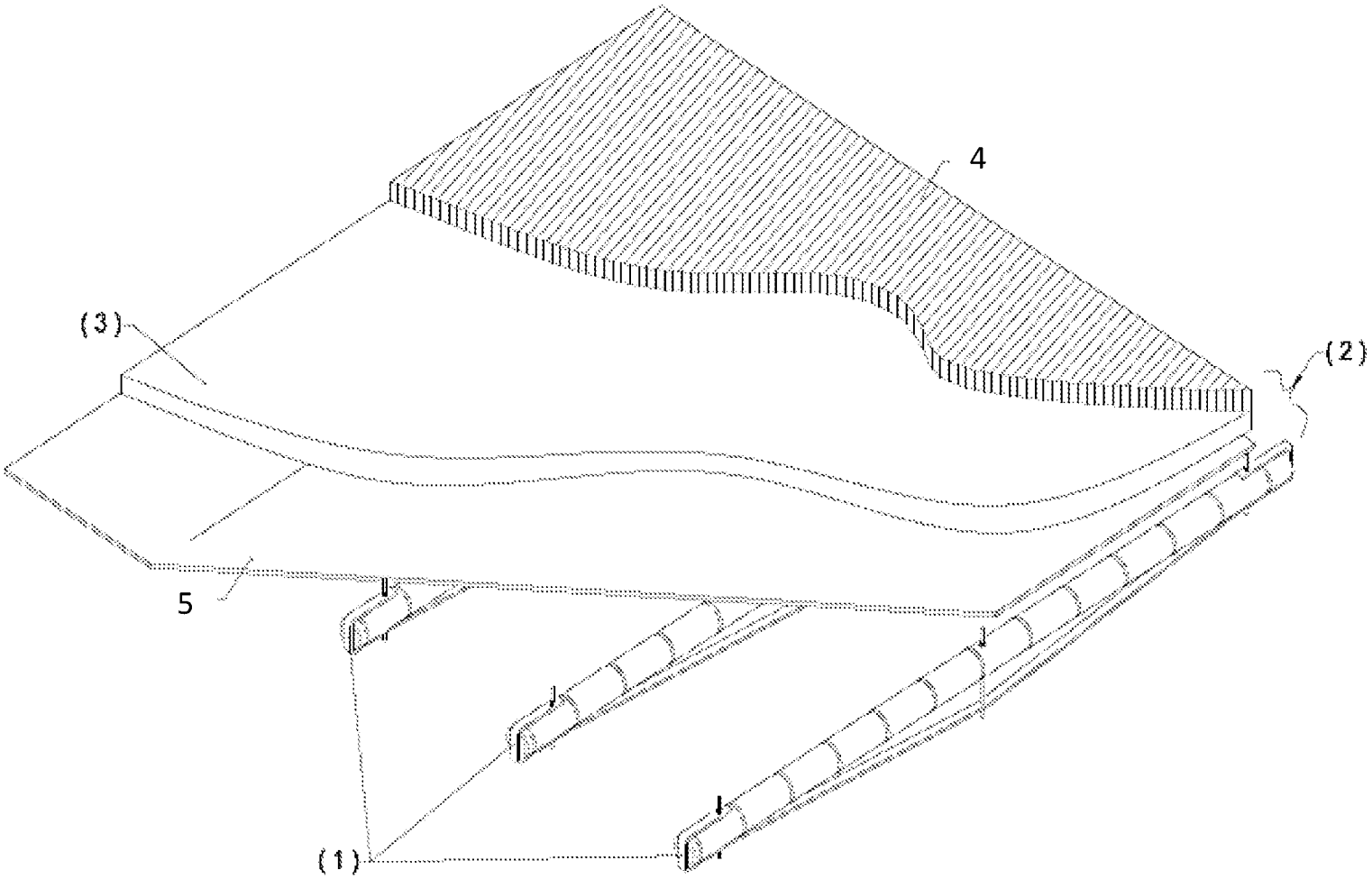
FIG. 1 shows the slab system working as a housing roofing or flooring where a parallel arrangement of pre-tensioned composite girders (1) is shown, consisting of a portion of bamboo culm and steel components over which a deck (2) is placed; said deck consists of one or several layers of material and is comprised of a structural diaphragm (3), a top finish (4) and a bottom finish (5).

The present invention as shown in FIG. 1 refers to a slab system consisting of pre-tensioned composite girders installed in parallel arrangement (2), and supporting a deck (2). The deck consists of one or several layers forming a structural diaphragm (3), the top finish (4) and the bottom finish (5) of the system, which may consist of different materials (such as concrete, steel, masonry, wood, bamboo or a combination thereof). According to FIG. 2, each girder has a portion of bamboo culm (6) and a profile connecting to the culm (7), with bolts (8), nuts (10), and washers (11) for fastening the profile to the culm by inserting the bolts into previously perforated bores that vertically aligned pass through the profile and the culm; the nuts and washers are used to fasten them. The nuts are threaded into the bolts and rest on the profile via the washers, thus generating a condition of compression stress between the culm and the profile. The profile is arranged on the bottom part of the culm with symmetric geometry with respect to the center of the span and with a variable distance to the culm, but said distance is maximum at the central zone, linearly approaching the culm until making contact with it at the ends thereof. Moreover, the girder consists of a tube of greater diameter than the bolt located midway the span. As shown in the separator tube (9) of FIG. 2, the tube sheaths the bolt and is introduced to mechanically separate the bamboo culm from the profile. This tube rests on the bottom part of the culm, by means of a steel plate with the same curvature as the tube and of a length smaller than one third of the internode distance (12), to distribute over a larger area the compression caused by the tube on the bottom wall of the culm.

Figure 2:
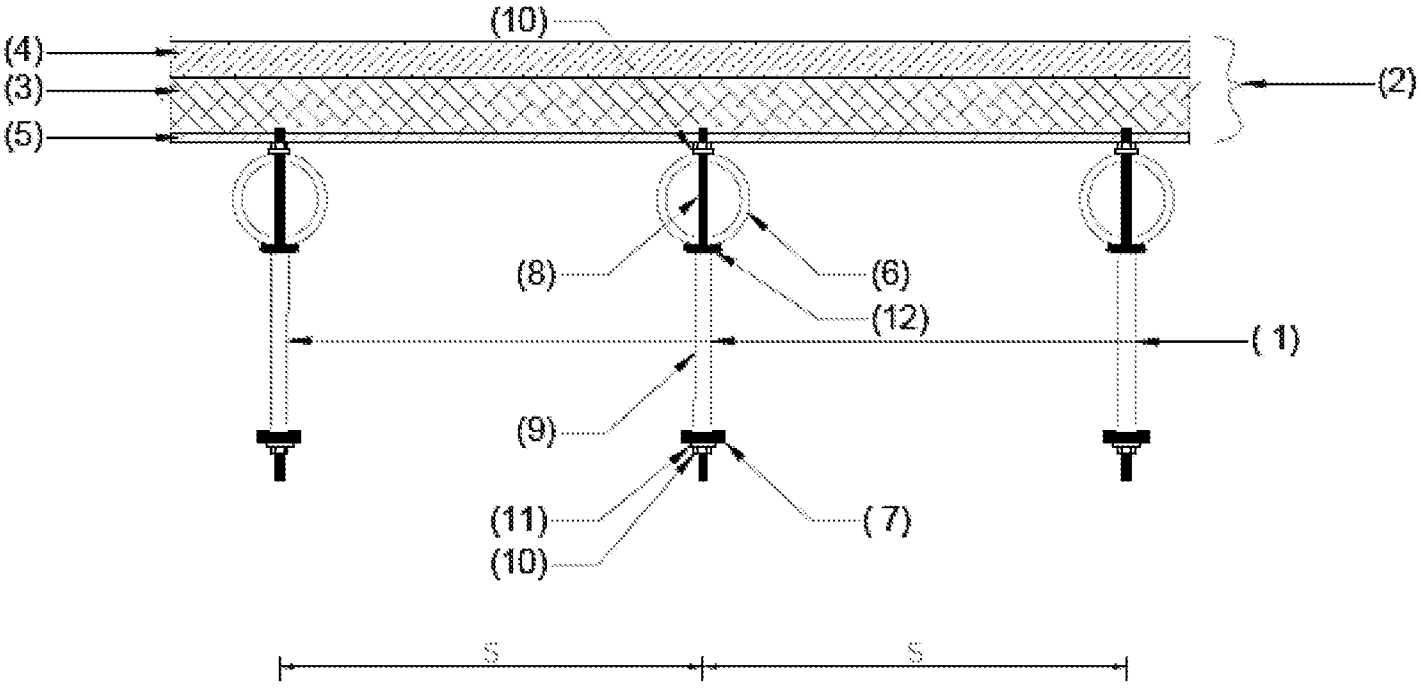
FIG. 2 shows a cross-section of the structural system for floors and roofs showing the arrangement of the pre-tensioned composite girders (1) that provide support for the deck (2), as well as all its components, such as the diaphragm (3), the top (4) and the bottom (5) layers, the bamboo culm, a metallic profile, a threaded bolt, a steel separator tube, nuts, washers, and plate, as indicated by numerals (6), (7), (8), (9), (10), (11) and (12) respectively.

FIG. 2 shows a cross-section of the system, in which the composite girders are arranged separated apart by a distance "s" whose magnitude depends on the structural design considering the load conditions of the system, the geometry of the target covered space, and the geometrical and mechanical characteristics of the bamboo and other materials. This figure shows the components of the slab in this section: the potential layers of the deck (2) forming the diaphragm (3), and the top (4) and the bottom (5) finishing, the bamboo culm (6), the profile (7), the bolt (8), the separator tube (9), the nuts (10) and the washers (11).

Figure 3:
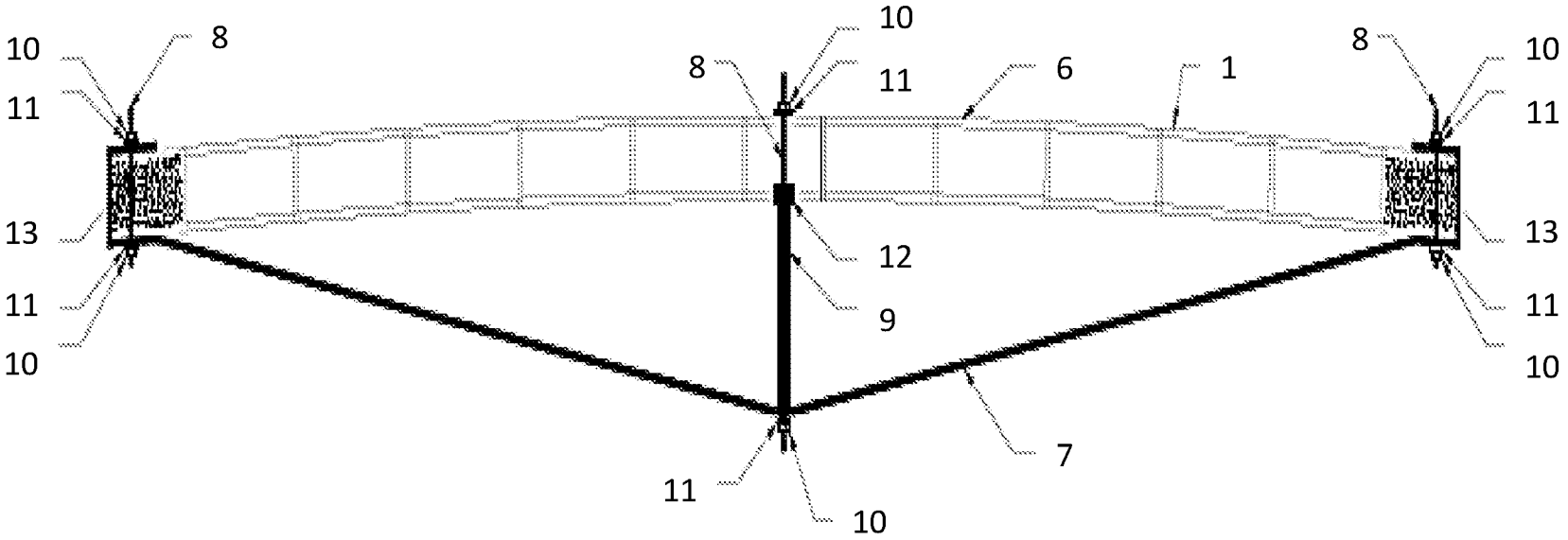
FIG. 3 shows a longitudinal view of the pre-tensioned composite girder that provides support to the slab, following the same numbering of components as in FIGS. 1 and 2, showing the cambered geometrical configuration resulting from the pre-tensioning process.

FIG. 3 shows a possible geometric configuration of the composite pre-tensioned girder. This figure features the different components, whose number and arrangement will depend on factors such as the distance between the mounting supports on the ends, the acting loads and the architectural requirements and characteristics of the raw materials. The composite girders (1) rest on the ends over walls, columns or beams made of steel, concrete, wood or other material to provide support to the deck. The bamboo culm (6) may or may not have mortar (13), or other filling material in the internode spans where the beam rests, to prevent the occurrence of local failures. All the components are arranged so that the profile (7) is fastened to the ends of the bamboo culm, and there are one or more separator tubes (9) that produce a condition of stress to the profile and a condition of flexo-compression to the bamboo culm, compressing said tubes by pushing them towards the profile and the bamboo culm in opposite directions, until producing a cambered condition of the mechanical system and a pre-tensioned condition of the materials.

The bamboo longitudinal compression condition is produced due to a stress balancing action exercised by the profile due to the transfer of load to the ends of the culm. The proposed system achieves a mechanical condition allowing to obtain a reduced bottom deflection lower than the maximum permitted by the Official Mexican Standards for building methods and the Building Regulations of the Federal District (Mexico City). The fastened composite girders (1) subject to the presence of service load adopt a slightly curved condition. The bends of the profile together with the mortar filling, if any, at the ends of the bamboo culm have the function of freeing the bamboo from the shear stress load produced by the bolts, causing that the transmission of the profile load to the bamboo is achieved through the compression of the culm in the direction of its longitudinal fibers.

Any system used to keep the gap between the profile and the culm is considered a possible variation of the system, such as the introduction of nuts to prevent the culm and the profile from returning to their initial balance position. Another possible variation of the system is the introduction of additional bolts (with or without a tube) along the span length to cover greater distances. Another possible variation of the system is the introduction of any steel component that works under tension as a replacement of the profile, such as a rigid or flexible cable. Still another possible variation of the system is the absence of camber for roofs subject to a wind driven suction action. Other possible variations include any form of filling in any of the internode span to prevent local failures, or in points where there are bolts connecting to the deck, or elements for bracing the composite girder.

The differences with the existing patented systems lay on the fact that in the present invention the compression is being absorbed by the bamboo culm section and not by a system with a girder manufactured with laminated bamboo. The stress is absorbed by a steel component placed outside the culm, thus achieving an optimum performance of the materials. The pre-tensioned condition makes the bamboo and the steel work together from the beginning and not when the stress forces from the service load start to appear. The condition of the girder ends at the mounting support free the bamboo culm from the possibility of crushing and/or tearing due to shear stress.

The pre-tensioned composite girder has the fundamental property of dissipating energy due to its non-linear behavior to the failure.

The present invention is a system of geometrical and mechanical configuration that meets all the requirements of the current domestic and foreign building regulations. The system is light in weight and, for example, during an earthquake it allows floor slab displacements of small magnitude, and its deformation condition due to dead and live loads is low due to the resistance of steel and bamboo, and the pre-tensioned condition of the composite girders.

Having described the invention in sufficient detail, we consider it as a novelty, and therefore, we claim as our exclusive property the contents of the following claims:

1. A slab system comprising:

a deck comprising one or more layers which form a structural diaphragm and at least one of a top finishing layer and a bottom finishing layer; and a plurality of pre-tensioned composite girders installed in a parallel arrangement to support the deck, the pre-tensioned composite girders including a hollow bamboo culm having first and second opposite longitudinal ends defining a length from the first longitudinal end to the second longitudinal end with a central zone therebetween, and a profile having a length greater than the length of bamboo culm.

2. The slab system according to claim 1, where the profile is fastened to the bamboo culm at its longitudinal ends and at the central zone so that a distance between the length of bamboo culm and the profile is greatest at the central zone and the distance is linearly variable until the profile contacts the bamboo culm at the longitudinal ends.

3. The slab system according to claim 1, where the profile is fastened to the bamboo culm using a plurality of bolts and nuts that allows connection through a plurality of bores in the bamboo culm at connection points thereof that simultaneously pass through the profile and the bamboo culm in vertically aligned orientation.

4. The slab system according to claim 3, wherein at least one internode length of the bamboo culm is filled with a mortar at a connection point and prevents shear stress failures or crushing of one or more culm walls.

5. The slab system according to claim 3, wherein at least one bends of the profile at one or more connection points generates a compression condition in the bamboo culm when the profile is under stress, thereby reducing a shear stress load on the bamboo culm.

6. The slab system according to claim 3, wherein the bolts provide an axis about which a respective separator tube resides to separate the profile from the bamboo culm.

7. The slab system according to claim 1, where the pre-tensioned composite girder comprises a separator tube of greater diameter than a bolt located midway in a span of the central zone; the tube sheathing the bolt with the tube mechanically separating the bamboo culm from the profile and generating a compression stress between the bamboo culm and the profile.

8. The slab system according to claim 7, further comprising a second spacer tube of greater diameter than a second bolt located along the length of the pre-tensioned composite girder.

9. The slab system according to claim 1, wherein each composite pre-tensioned composite girder includes a profile including a steel plate having a curvature matching an outer curvature of a respective one of the bamboo culms, and a separator tube supporting the respective bamboo culm over the steel plate which distributes a compression stress over a larger area.

10. The slab system according to claim 9, wherein the steel plate having the curvature of the bamboo culm has a length no smaller than a third of an internode distance and is a support for a separator tube reducing a shear stress generated by the separator tube on a bottom wall of the bamboo culm.

11. The slab system according to claim 1, wherein the deck is comprised of at least one of concrete, steel, masonry, adobe, wood, composite materials, polyaluminum, bamboo, polystyrene, mineral wool, and mineral insulation material.

12. The slab system according to claim 1, wherein the pre-tensioned composite girder includes a gap between the bamboo culm and the profile along the central zone resulting in a condition of stress in the profile balanced by a compression produced in the length of bamboo culm.

13. The slab system according to claim 1, wherein the bamboo culm is arranged horizontally with a top of the bamboo culm allowing connection with the deck to which the pre-tensioned composite girders provide support.

14. The slab system according to claim 1, wherein the pre-tensioned composite girder generates a mechanical condition known as flexo-compression, which is produced by a spatial arrangement of a bamboo culm span.

15. The slab system according to claim 1, wherein the profile is fastened to the longitudinal ends of the bamboo culm producing a condition of stress in the profile and flexo-compression in the bamboo culm.

16. The slab system according to claim 1, wherein at least one pre-tensioned composite girder is configured with light weight, rigidity and high mechanical resistance to bear loads and deformations transmitted by the deck.

17. The slab system according to claim 1, wherein the pre-tensioned composite girder has a cambered geometrical configuration.

18. The slab system according to claim 1, wherein the profile is wrapped around the longitudinal ends of the bamboo culm, ending on a top side of the bamboo culm adjacent the deck.

* * * * *